United States Patent [19]

Bunting et al.

[11] Patent Number: 4,913,125

[45] Date of Patent: Apr. 3, 1990

[54] CUTTER PICKS

[75] Inventors: Derek J. Bunting, Sapcote; Alexander B. Graham, Hinckley, both of England

[73] Assignee: Sandvik AB, Sandviken, Sweden

[21] Appl. No.: 221,408

[22] Filed: Jul. 19, 1988

[30] Foreign Application Priority Data

Jul. 20, 1987 [GB] United Kingdom ..... 8717116

[51] Int. Cl.[4] ..... B28D 1/26

[52] U.S. Cl. ..... 125/43; 125/40

[58] Field of Search ..... 125/43, 40, 29, 6, 42

[56] References Cited

FOREIGN PATENT DOCUMENTS 3434348 2/1986 Fed. Rep. of Germany ..... 125/43
1104924 3/1968 United Kingdom .
2055434 3/1981 United Kingdom .
1604667 12/1981 United Kingdom .

*Primary Examiner*—Judy Hartman
*Assistant Examiner*—Maurina Rachuba
*Attorney, Agent, or Firm*—Burns, Doane, Swecker & Mathis

[57] ABSTRACT

A mineral cutter pick and its pick box are secured together through a spigot and socket connection. Opposed end faces of the pick and holding device that surround the connection have laterally oppositely inclined surfaces at opposite sides of a central plane of the pick extending in the direction of cutting movement. These complementary inclined faces improve the load distribution between the pick and its locking device in use and can also be arranged to restrict the entry of foreign matter into the spigot and socket connection.

9 Claims, 3 Drawing Sheets

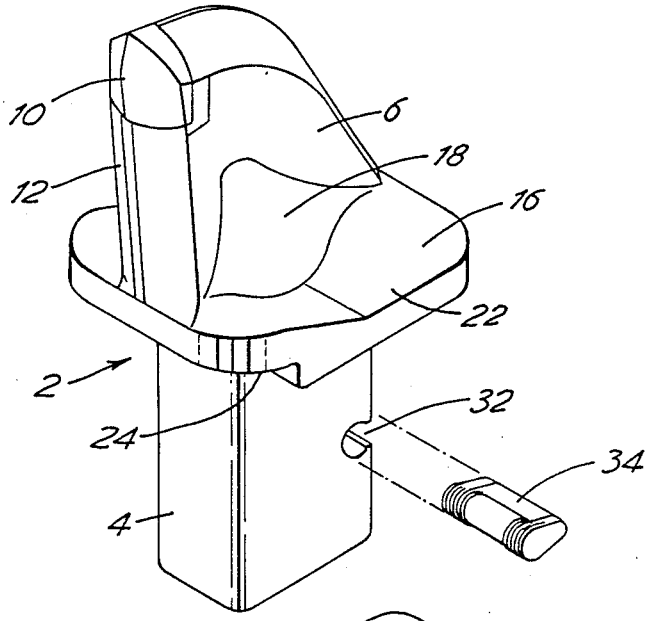
FIG. 3
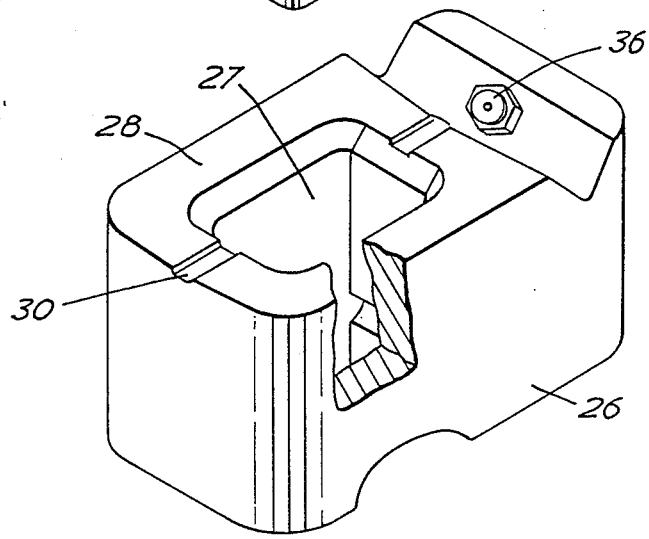

CUTTER PICKS

BACKGROUND OF THE INVENTION

This invention relates to mineral cutter picks and to assemblies of such picks with holding devices, for purposes such as breaking and excavating and having applications in mining, construction and civil engineering apparatus such as coal cutting machines.

Typically, a mineral cutter pick has a rearwardly projecting shank that is inserted into a correspondingly shaped aperture in its holding device in the manner of a spigot and socket connection. Locking means act between the pick and the holding device to retain the shank in the aperture during use.

As an example, in British Pat. No. 1,104,924 a cutter pick has a rectangular cross-section shank with a tapered outer portion that is drawn into engagement with the correspondingly tapered walls of the pick box slot by a locking pin. This construction has the disadvantage that an awkward and time-consuming machining operation is required to form the pick box slot so as to achieve the taper fit with the pick shank. In other known constructions, a constant cross-section shank and socket connection is used even though the manufacturing tolerances demanded for economic manufacture leave substantial paths for foreign material to penetrate into the connection. In the hostile environment of mineral cutting operations, rapid wear can result from the relative movement of the shank in the socket, accelerated by the presence there of foreign matter. In the examples of British Pat. No. 1,604,667 and No. 2,055,434 a shoulder is provided at the outer end of the shank for abutment against the outer face of the holding device surrounding the aperture. In such an arrangement the shoulder may go some way to shielding the aperture but it cannot exclude all foreign material. The movements that occur between the pick shank and its receiving aperture because of the slack fit between them still take place and the inevitable impress of foreign matter accentuates the adverse effects of these movements.

SUMMARY OF THE INVENTION

According to one aspect of the present invention, there is provided a cutter pick for assembly with a pick box or other holding device through a spigot and socket connection, the pick having an outwardly extending head that terminates at a cutting tip and being provided at an inner region with an element of said connection, the pick further comprising an inwardly directed face having laterally oppositely inclined surfaces at opposite sides of a central plane of the pick extending in the direction of cutting movement, each surfaces being arranged for abutment with opposing surfaces of the holding device.

According to another aspect of the invention, there is provided an assembly of a cutter pick with a pick box or other holding device having a spigot and socket connection between them, and locking means to maintain the connection between the pick and holding device, the socket opening onto an end face of the pick or holding device, an end face having laterally oppositely inclined surfaces at opposite sides of a central plane of the pick extending in the direction of cutting movement, and the spigot projecting from an end face of the other parts of the assembly, an end face having inclined surfaces for abutment with the socket end face inclined surfaces.

According to a further aspect of the invention, there is provided a pick box or other holding device for such an assembly.

It will usually be appropriate to arrange the abutment surfaces symmetrically to the central plane of the pick. The surfaces may define an included angle of 90°–175°, with the lower limit preferably being not less than 120° and advantageously 160°.

In one form of pick according to the invention, the pick has a rearwardly extending shank to provide the spigot element of the connection and at the forward end of the shank the pick has a flange or skirt projecting outwardly at least at laterally opposite sides of the pick and having inclined surfaces for abutment with complementary surfaces of the pick box. Preferably, in this instance, the surfaces are inclined outwardly away from the shank and towards the cutting tip.

In each case, it is preferred that between the opposed faces of the pick and its holding device, e.g., at the front of the pick, a gap is formed to receive an extraction tool for separating the assembly. Where the pick is provided with flange or skirt, this may continue around the front of the pick and have a stepped inner face to form that gap.

Preferably, in the assembly of such a pick box with its pick, the pairs of inclined surfaces of the pick box outer face and pick skirt inner face are at corresponding angles, so that these faces are substantially in contact with each other over the whole of their overlapping areas.

BRIEF DESCRIPTION OF THE DRAWINGS

Embodiments of the invention will be described by way of example by reference to the accompanying drawings.

FIG. 3 is an exploded view of the assembly in FIGS. 1 and 2.

DESCRIPTION OF THE PREFERRED EMBODIMENTS

Figure 1:
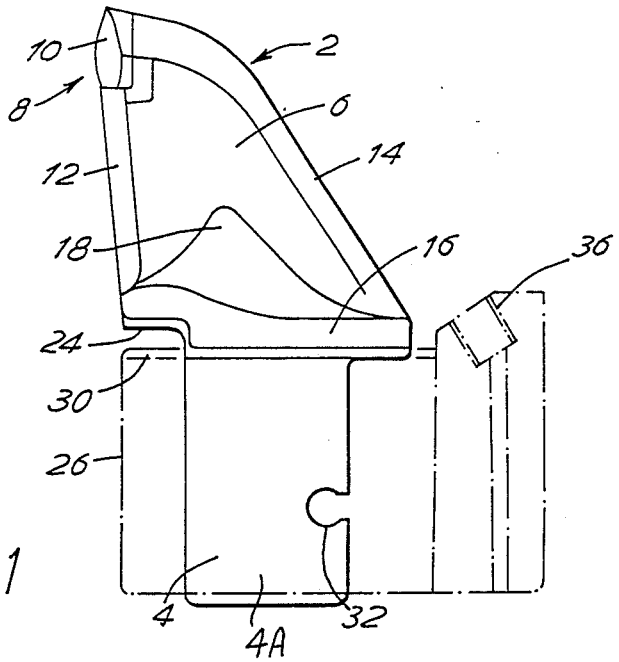
FIGS. 1 and 2 are side and front views respectively of a coal cutter pick according to the invention, with its associated pick box indicated in broken lines.

The pick 2 shown in FIGS. 1 and 3 of the drawings comprises a rectangular cross-section shank 4 and a tapered, forwardly inclined head 6 which extends outwards to terminate in a forward cutting tip 8 having a brazed hard metal insert 10. The cutting tip is bisected by a center plane P of the pick, which plane is disposed intermediate the lateral sides 4A of the spigot. The head is of lesser width than the shank and has V-form front and rear faces 12,14. Between the shank and the head there projects a peripheral flange or skirt 16. Buttress portions 18 are integrally formed between the skirt and the adjoining lateral faces of the head.

The laterally opposite sides of the skirt 16 project from both the shank and the head, but the maximum front-to-rear dimension of the root of the head is substantially the same as the corresponding dimension of the skirt. The skirt has a tapered thickness, both the inner faces 20 and the outer faces 22 of its lateral regions include laterally opposite surfaces 20A, 20B and 22A, 22B which are inclined relative to one another to define an imaginary line of intersection L lying in the central plane of symmetry P of the pick containing the longitudinal axis of the pick Thus, the pick tends to be centered in the lateral direction. The preferred included angle of the inner faces 20 is in the range 120°-175°, preferably 160°-175°. The oppositely inclined outer surfaces 22 may include a similar angle. A step at the front of the skirt 16 forms an outwardly offset portion 24 relative to the lateral regions of the skirt.

The pick box 26 has a socket 27 opening onto an outer wall comprising laterally opposite surfaces 28 inclined at complementary angles to the inner lateral surfaces 20 of the pick skirt, i.e., having an included angle which is substantially complementary to the angle subtended by the pick inner faces 20. These surfaces are separated by a groove 30 which is bisected by the center plane P and which runs the length of the outer wall to provide clearance for any forging flash on the pick, so that the opposed inclined surfaces 20,28 of the skirt and pick box can fit together closely. The offset portion 24 at the front of the skirt leaves a positive clearance between the pick and the box that provides a purchase for an extraction tool when the pick is to be removed from the box. The rectangular shank 4 has substantial radii on each corner and the pick box has complementary radii. This results in a stronger box than is provided by known designs having sharp corners.

The pick shank is illustrated with a slot 32 for a locking device 34 retaining the pick in the box. Preferably the device is of a form that draws the opposed inclined faces together so as to hold them in substantially face to face contact. In this way the passage of foreign matter between them is minimized. The pick box is also shown with a connection 36 for a water spray to suppress dust during cutting operations.

Figure 4:
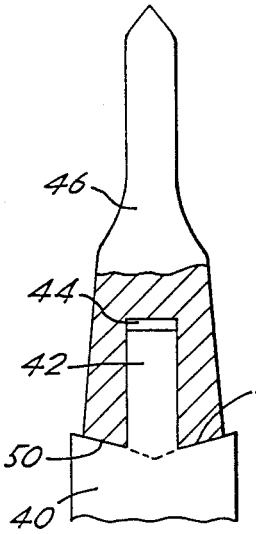
FIGS. 4 and 5 are partly sectioned front and side views of an alternative assembly according to the invention.
Figure 5:
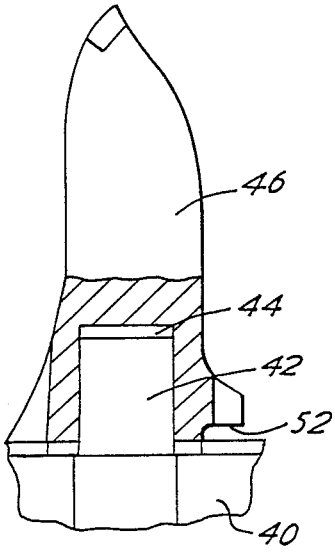

In the example of FIGS. 4 and 5, the pick box or other holding device 40 has a uniform cross-section projection 42 that is inserted into a corresponding cross-section aperture 44 in the inner face of the pick 46. A locking device (not shown), which may be similar to the device 34, secures the assembly. Similarly to the first example, the outer face of the holding device 40 surrounding the projection 42 is formed with laterally inclined surfaces 48 extending outwards from a central plane of symmetry of the assembly, and the inner face of the pick surrounding its aperture 44 has complementary inclined surfaces 50. As in the first example, a step at the front of the pick forms an outwardly offset portion 52 for inserting an extraction tool.

Figure 2:
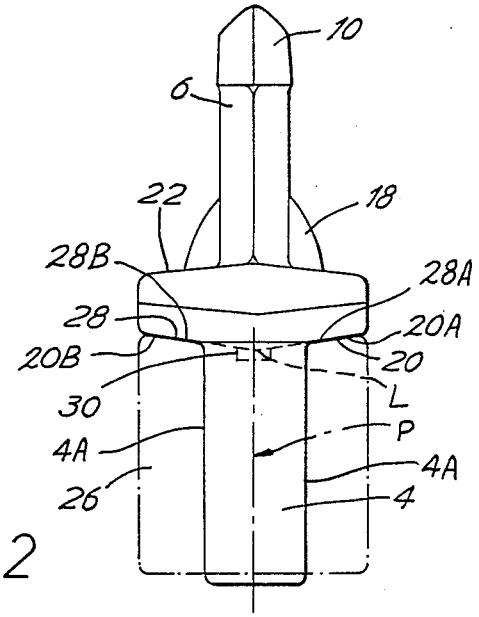
Figure 6:
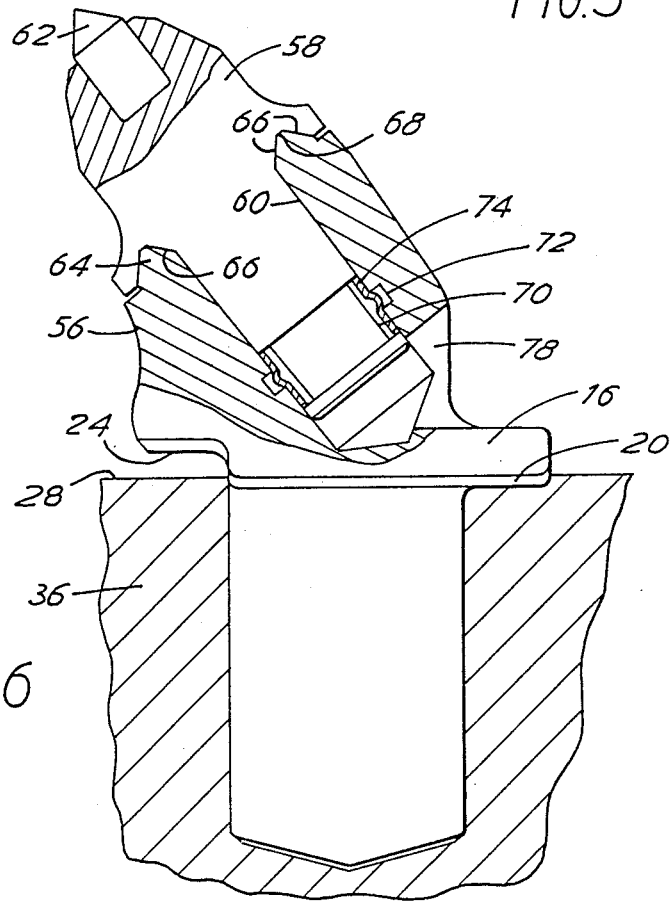
FIG. 6 is a partly sectional side view of another alternative assembly according to the invention.

In FIG. 6 an embodiment of the invention is illustrated which has many features in common with the example of FIGS. 1 to 3, utilizing the same pick box 36. Locking means are provided to retain a pick in the pick box but are not illustrated as they can be of conventional form. This further example has a two part cutter pick, namely a body part 56 and a detachable head part 58. The body part includes the skirt 16 with its inclined faces 20,22 that meet with complementary faces 28 on the pick box 36. A circular bore 60 extending into the outer end of the body part 56 obliquely to the rectangular shank 4 receives the head part 58 in the form of a point attack tool, having a hard-metal cutting tip 62. The construction illustrated in this embodiment can be modified, however, with the adoption of other forms of cutting tool and/or other forms of tool shank.

At the outer end of the bore 60 there is an annular projection 64 with radially inner and outer faces 66 inclined conically to the axis of the bore. The tool part has a complementary recess 68 which bears upon the annular projection. The tool part has a cylindrical recess 70 near its inner end and this registers with a smaller recess 72 around the bore of the body part when the tool is fully inserted. A locking member 74 is located in the recesses to retain the tool in position. The locking member of a kind known as a "dog collar" comprises a resilient open-ended ring mounted on the tool shank and formed with a series of projecting pips that engage in the body member recess. At its inner end the bore 60 breaks into an opening 78 in the body part, into which a lever or drift (not shown) can be inserted to release the head part 58 from the body part 56.

The preferred included angle of the pairs of inclined faces is in the range 120°-175°, and advantageously 160°-175°. In any of the illustrated examples it is possible to form the inclinations in the opposite sense, ie., so that from their central junction the inclined surfaces extend inwardly, away from the cutting tip of the tool. In the examples of FIGS. 1-3, however, the outward inclination of the surfaces is preferred for more economical production of the pick as a forging.

We claim:

1. A cutter pick for assembly with a pick holder by means of a spigot and socket connection of non-circular cross section, said cutter pick including a head projecting in an outward direction and a cutting tip formed at a front end of said head, said cutting tip being bisected by a center plane of said cutter pick, said cutter pick including a face which faces in an inward direction generally opposite said outward direction, said face including laterally opposite surfaces inclined relative to one another to define an imaginary line of intersection lying substantially in said center plane, said surfaces adapted to engage corresponding surfaces of a pick holder for centering said cutter pick in the lateral direction.

2. A cutter pick according to claim 1 having an inwardly extending shank which defines the spigot of said connection, a flange at an outer end of the shank projecting to laterally opposite sides of the pick, said flange having said inclined surfaces.

3. A cutter pick according to claim 2, wherein the flange has a step defining a recess for receiving an extraction tool to remove the pick from a pick holder.

4. A cutter pick according to claim 1, wherein the socket of said connection opens into said inwardly directed face of the cutter pick.

5. A cutter pick according to claim 1, wherein said laterally opposite surfaces of the cutter pick converge in said inward direction.

6. A cutter pick according to claim 1, wherein said laterally opposite surfaces define an included angle of 90 to 175 degrees.

7. A cutter pick according to claim 6, wherein said included angle is 120 to 175 degrees.

8. A cutter pick according to claim 6, wherein said included angle is 160 to 175 degrees.

9. In combination, a cutter pick and a pick holder assembled together by means of a spigot and socket connection of non-circular cross section and removable fastening means for securing said spigot in said socket, said cutter pick including a head projecting in an outward direction and a cutting tip formed at a front end of said head, said cutting tip being bisected by a center plane of said cutter pick, said cutter pick including a first face which faces in an inward direction generally opposite said outward direction, said face including laterally opposite first surfaces inclined relative to one another to define an imaginary line of intersection lying substantially in said center plane, and said pick holder including a second face which faces in said outward direction, said second face including laterally opposite second surfaces, said second surfaces inclined substantially complementarily to said first surfaces and abutting said first surfaces to laterally center said cutter pick.

* * * * *